United States Patent [19]

Morgner et al.

[11] 4,224,720

[45] Sep. 30, 1980

[54] APPARATUS FOR THE OPENING-UP AND CLEANING OF COTTON WASTE

[75] Inventors: Friedrich W. Morgner, Bergisch Gladbach; Franz Höck, Overath; Hans G. Stock, Cologne, all of Fed. Rep. of Germany

[73] Assignee: Temafa Textilmaschinenfabrik Meissner, Morgner & Co. GmbH, Bergisch Gladbach, Fed. Rep. of Germany

[21] Appl. No.: 968,616

[22] Filed: Dec. 11, 1978

[30] Foreign Application Priority Data

Dec. 12, 1977 [DE] Fed. Rep. of Germany ..... 2755380

[51] Int. Cl.[2] ..... D01B 1/00; D01B 1/08

[52] U.S. Cl. ..... 19/204; 19/303

[58] Field of Search ..... 19/83, 96, 204, 303, 19/306

[56] References Cited

U.S. PATENT DOCUMENTS

| | | | |
|---|---|---|---|
| 1,355,518 | 10/1920 | Von Osten | 19/83 |
| 1,425,920 | 8/1922 | Von Osten | 19/83 |
| 2,810,163 | 10/1957 | Kyame et al. | 19/96 |
| 2,825,097 | 3/1959 | Kyame | 19/96 |
| 3,457,595 | 7/1969 | Schulze | 19/204 X |
| 3,604,062 | 9/1971 | Hollingsworth | 19/113 |
| 3,604,475 | 9/1971 | Hollingsworth | 140/97 |
| 3,941,530 | 3/1976 | Platt | 19/303 X |
| 4,097,965 | 7/1978 | Gotchel et al. | 19/306 |

FOREIGN PATENT DOCUMENTS

| | | |
|---|---|---|
| 1510282 | 1/1970 | Fed. Rep. of Germany . |
| 2459781 | 1/1976 | Fed. Rep. of Germany . |

*Primary Examiner*—Louis Rimrodt

*Attorney, Agent, or Firm*—Becker & Becker, Inc.

[57] ABSTRACT

An apparatus for the opening-up and cleaning of cotton waste, especially strips, card fly and scutcher material and the like with a fiber material draw-in roller for feeding the fiber material to be cleaned to a saw tooth barrel the peripheral portion of which includes an opening-up section for opening-up the fiber material to be cleaned into individual fibers. When viewing the saw tooth barrel in its direction of rotation, the opening-up section is followed by a fiber material take-off roller rotatable in a direction counter to the direction of rotation of the saw tooth barrel. The apparatus furthermore includes a conduit having an inlet adjacent the peripheral surface of the saw tooth barrel for receiving fiber material therefrom and having an outlet for connection to a fiber material collecting container.

27 Claims, 9 Drawing Figures

APPARATUS FOR THE OPENING-UP AND CLEANING OF COTTON WASTE

The invention relates to apparatus for the opening and cleaning of cotton waste, more especially strips, card fly, scutcher material and the like, with a fiber-draw-in roller for feeding the fiber material to a saw tooth barrel around the periphery of which is provided an unraveling section for the opening of the fiber material into separate fibers.

There are known so-called carders used for the removal of vegetable matter from wool, more especially cotton. The main working components of these for the opening of the fiber floccules are series-arranged barrels such as a preliminary roller, preliminary barrel, main barrel and the like around which are grouped in planetary fashion smaller rollers rotating in opposed direction comprising so-called worker rollers and clearers or strippers. Simple carders comprise for example a preliminary roller with burr beaters, a main barrel with sets of worker rollers and clearers and a take-off or detaching roller.

There are also known so-called scutchers (beating machines) which are employed for opening and cleaning cotton with considerably greater intensity. In these, fiber floccules clamped by a cylinder press are repeatedly hit by a circular beater. Indididual beating lugs may be replaced by beating bars, needle rollers or saw tooth barrel or carding beaters. To the saw tooth barrels or rollers are normally allocated grills (bar or knife grills) through which the freed foreign matter drops.

The German Offenlegungsschrift No. 15 10 282 contains for example a description of a cleaning grill for cleaning machines for fiber materials. This cleaning grill comprises alternate grill bars and separating roller with ribbed or fluted circumferences.

The German Offenlegungsschrift No. 24 59 781 discloses an apparatus for the removal of fiber nep, foreign matter particles and the like during the carding of fiber materials. This apparatus comprises at least one cylinder roller with trough or draw-in roller means or transmission roller to a further cylindrical roller and a take-off device.

These prior art carders are not only to a certain extent suitable for the opening and cleaning of cotton waste. In this context it has to be noted that so far there has specifically not been disclosed any device which would make it possible to process so-called scutch. Currently-followed practice in the recovery of cotton waste comprises normally a separation of, on the one hand, strips and card fly capable of further processing, and, on the other hand, scutch, which up to now could not be satisfactorily processed and was consigned to waste. In this context it has to be borne in mind that the raw material contains about 3.5% of this low value cotton constituent or scutch.

The U.S. Pat. No. 3,941,530 Platt dated March 1976 discloses an apparatus for the opening and cleaning of cotton waste. This apparatus comprises a fiber-material draw-in roller for feeding the fiber material to a saw tooth barrel the periphery of which is assigned to at least one worker roller. The rotational speed of the latter is less than that of the saw tooth barrel and the worker roller is followed by a fiber detaching device to which adjoins a duct leading to a fiber material collector container. In the case of waste fiber material recovered by this known apparatus, the waste or pieces of residue is basically a high grade fiber material such as for example edge strips from needled lengths of textile cloth. The purpose of this prior art apparatus is thus the unraveling after heat treatment of high grade fiber material which had already been previously opened during carding and is suitable for the production of needled lengths of cloth and has been cut off from such lengths of cloth. This known apparatus is neither intended nor suitable for the recovery of low value cotton waste, especially scutcher material.

The invention has the object of providing an apparatus for the opening and cleaning of cotton waste which also permits the recovery and cleaning or opening of the scutcher material, in which context a more especial requirement is the achievement of optimum separation between fiber material capable of further use and waste dust, especially trash.

In solving this problem, the apparatus in accordance with the invention is according to one aspect of the invention characterized in that, viewed in the direction of rotation of the saw tooth barrel, the unravelling section is followed by a fiber-take-off roller rotating in a direction opposed to that of the saw tooth barrel, and in that the fiber-take-off roller is adjoined by, or has associated therewith, a duct leading to a fiber-material collecting container.

In a preferred embodiment, the fiber-take-off roller is surrounded over an arc of a circle by an arc-shaped baffle plate the exposed front edge of which faces, and is spaced from, a generating line of, or the overall periphery of, the saw tooth barrel.

In this way there is formed between a shell of the fiber-take-off roller and the arc-shaped baffle plate a curved duct in which, when the fiber-take-off roller rotates, there is imparted to the fiber material and any trash still adhering to it a high degree of acceleration as a function of the peripheral speed, as a result of which there occurs at the outlet from the duct a centrifugal-force-induced separation between product fibers and trash which has a higher specific gravity than the product fibers. The trash separation by the take-off roller may thus be effected solely against atmospheric pressure, e.g. there is no need for the artificial generation of a partial vacuum.

The gap between the leading free edge of the baffle plate and an approximate tangent between the saw tooth barrel and the take-off roller may be 20 to 35 mm, preferably about 35 mm, while the gap between this leading edge of the baffle plate and the generating line or periphery of the saw tooth barrel as determined by the saw tooth points may be 0 to 10 mm wide, preferably about 0.2 mm wide.

Viewed in the direction of rotation of the saw tooth barrel, the baffle plate may be followed by a dust extraction duct forming a suction funnel having a suction aperture presented towards the saw tooth barrel and extending substantially from the baffle plate to the fiber-material draw-in roller. This suction funnel arranged substantially in the entire upper region of the saw tooth barrel or drum ensures the continuous extraction of fine dust. During operation of the apparatus a certain amount of fine dust can be set free as a result of fine dust particles adhering to the saw toothed means and not previously detached by the take-off roller being thrown by centrifugal force off the saw tooth barrel, in consequence of a peripheral speed thereof of preferably 23 m/sec, into the empty space above the saw tooth barrel.

The baffle plate is preferably held so that it is specifically pivotally adjustable in relation to the take-off roller and surrounds the take-off roller over an angle range of from 90° to 180°, preferably about 135°.

Viewed in the direction of rotation of the take-off roller, there may follow behind the rear edge of the baffle plate a trash removal duct and adjoining this, a duct leading to a fiber-material collection container and separated from the trash removal duct by a trash or separating knife. The separating knife may be made from high-grade 0.5 to 1.5 mm thick steel clamped in a distortion resistant support structure. In the event of wear it is possible to just remove the steel knife and regrind or replace it. The trash knife serving to separate trash and product fibers may be adjustable relative to the take-off roller preferably both in respect of spacing and angle.

For a still better removal of the product material and the trash material it is beneficial to employ an arrangement in which the take-off roller is preceded by unravelling means comprising only one worker roller whereby the fiber product material may be drawn off from the take-off roller over a larger zone, whereby the trash or separating knife may occupy a substantially vertical position.

One or two worker rollers preceding the take-off roller and having the function of unravelling the fiber material requiring to be de-dusted into separate fibers, if at all possible, may in accordance with a modified embodiment be replaced by an arrangement with fixed cover mountings (card-master). This can give rise to a very much larger work effective contact area with the saw tooth barrel, producing better unravelling of fibers and thereby a better separation of product fibers and trash from the take-off roller.

The saw tooth drum preferably rotates with a peripheral speed of from 11 to 31 m/sec, more especially about 23 m/sec, while the take-off roller should rotate at a peripheral speed from 20 to 50 m/sec, more especially about 42 m/sec. The unravelling section between the fiber-draw-in roller and the take-off roller can comprise one or more worker rollers and a grill comprising, for example, a plurality of grill bars.

It is important to select the correct saw toothed members for the various rollers to obtain effective opening and cleaning. In accordance with the invention the saw toothed members having the following parameters may be fitted to the various rollers:

Saw tooth barrel: 0°, 12 threads per inch, pitch 6.5 mm

Draw-in roller: 0°, 12 threads per inch, pitch 6.5 mm

Worker roller: 10°, 16 threads per inch, pitch 4 mm

Take-off roller: 30°, 16 threads per inch, pitch 4 mm

The saw-toothed members, to which the above table refers, are elongate saw-toothed members arranged helically on the saw tooth barrel and on the draw-in, worker and take-off rollers, and in said table: (a) the expression "threads per inch" means the number of rows of saw teeth per inch measured parallel to the barrel or roller axis; (b) the expression "pitch" means the distance between adjacent saw teeth measured along a row of teeth; and (c) each of the angles specified is the angle between the shorter side of a saw tooth of a saw-toothed member and a radius of the respective part (barrel or roller) on which said saw-toothed member is mounted.

According to another aspect of the invention, there is provided apparatus for the opening and cleaning of cotton waste, more especially strips, card fly, scutcher material, and the like, with a fiber-material draw-in roller for the feeding of the fiber-material to a saw tooth barrel, to the periphery of which is assigned at least one worker roller, the peripheral speed of which is less than that of the saw tooth barrel, which also rotates with a greater peripheral speed than the draw-in roller, characterized in that, viewed in the direction of rotation of the saw tooth barrel, behind the draw-in roller and in front of the, or the first, worker roller there is located a grill comprising a plurality of grill bars or grill knives, and in that the draw-in roller rotates at a peripheral speed of from 0.47 to 4.3 m/min, more especially 0.8 m/min, the saw tooth barrel at a peripheral speed of from 11 to 31 m/sec, and the worker roller or rollers at a peripheral speed of from 1 to 6.5 m/sec.

The assignment in accordance with the invention of more or less known elements leads surprisingly to an apparatus which enables the opening and cleaning also of scutcher material so that the latter can be processed further. Experiments have established that about 55% of the scutcher material supplied can be recovered in this way, i.e. can be cleaned and opened in this way so that this material can be passed to further processing.

In the accompanying drawings, which, by way of example, show a number of embodiments of the invention:

Figure 1:
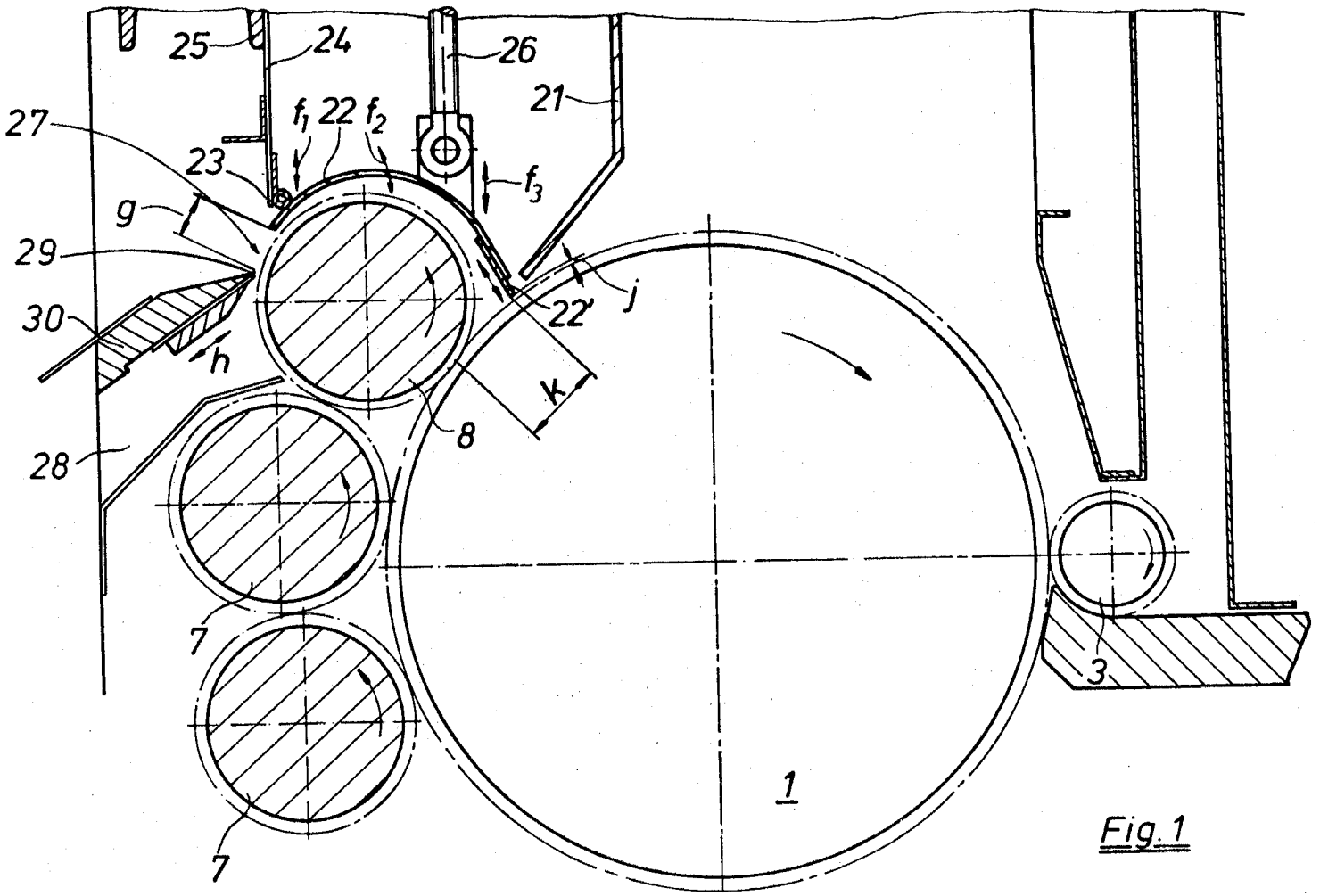
FIG. 1 is a diagrammatic view, partially in section, of an embodiment constructed in accordance with the invention.
Figure 2:
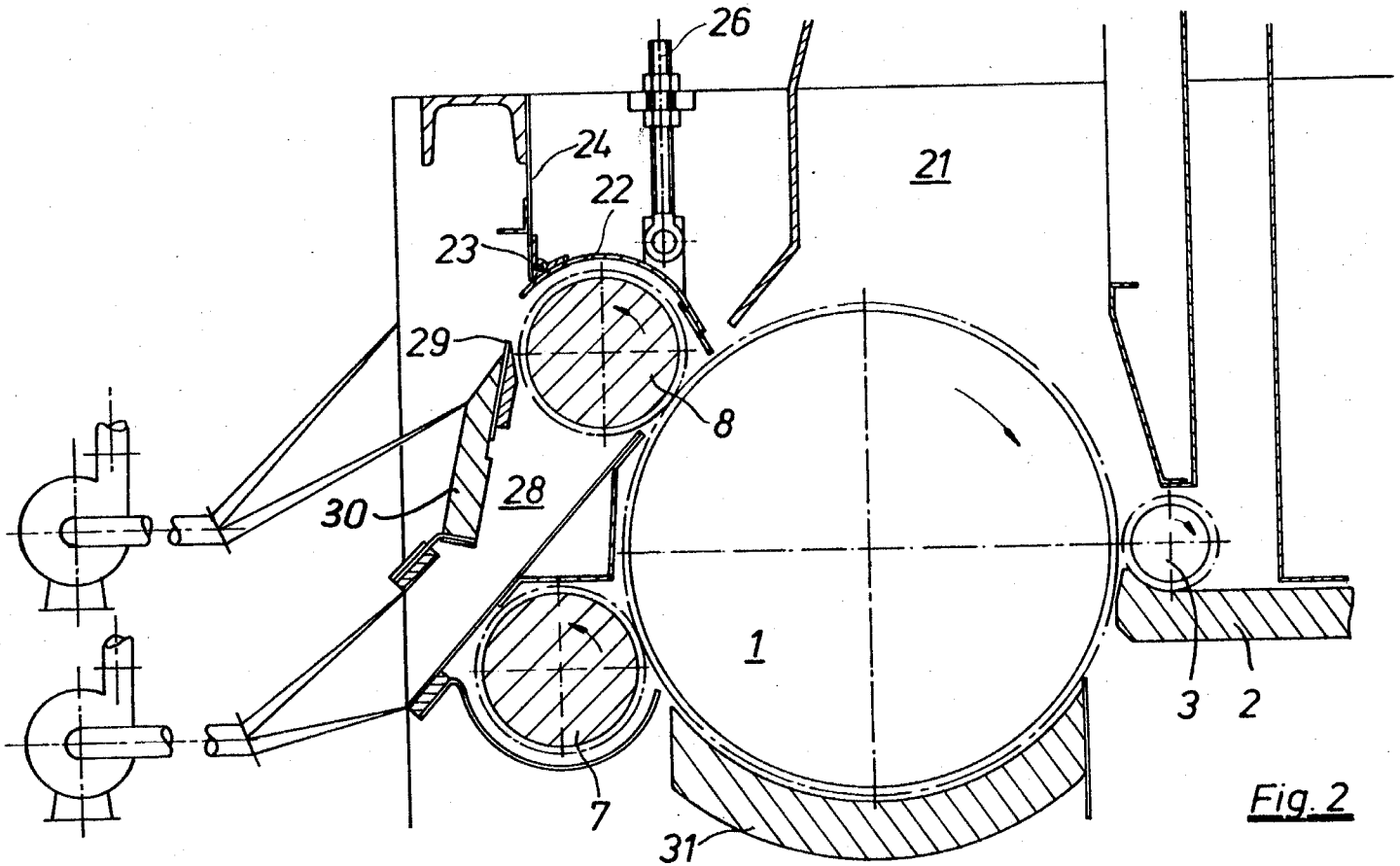
FIGS. 2 and 3 are diagrammatic views, partially in section, of two modified embodiments constructed in accordance with the invention.
Figure 3:
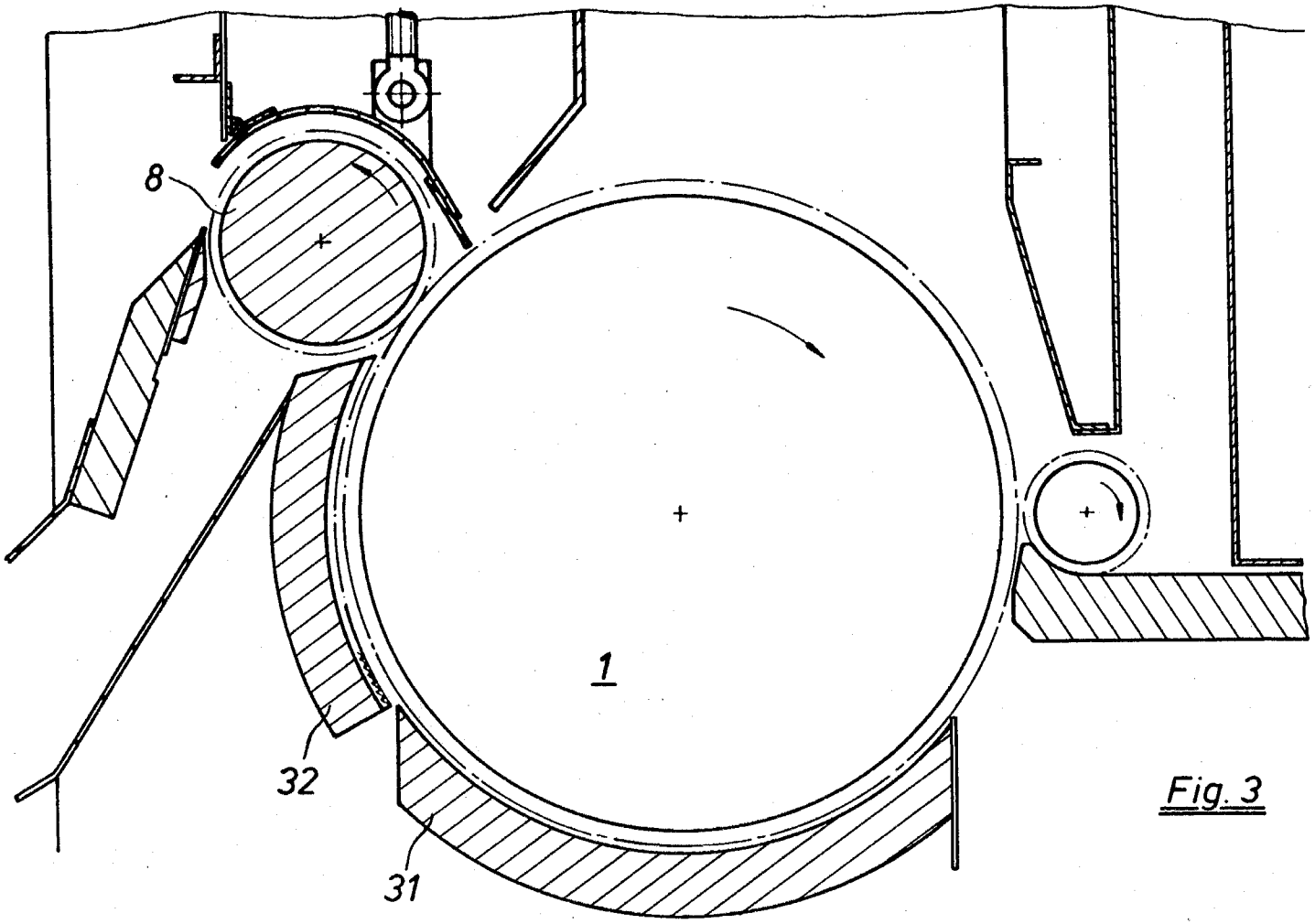

Referring now to the drawings in detail, the apparatus shown in FIGS. 1 to 3 comprises a drum, more specifically a saw tooth barrel, to which the fiber material to be opened is fed by means of a conventional draw-in unit which, besides a trough plate, comprises a grooved or fluted draw-in roller 3. The draw-in roller 3 and the saw tooth barrel 1 rotate in like directions and the teeth of the saw tooth barrel point in the direction of rotation of the latter. The saw tooth barrel has for example a diameter of about 300 mm so that a rotational speed of, for example, 1450 revolutions per minute the resultant peripheral speed will be about 23 m/sec. The draw-in roller rotates preferably at a peripheral speed of from 0.47 to 4.3 m/min.

According to the embodiment shown in FIG. 1, when viewing in the direction of rotation of the saw tooth barrel, the draw-in means is preferably followed by a not-shown grill section which in turn is followed by two worker rollers 7. Underneath the not-shown grill section there is, for example, arranged a collector funnel leading into a dust extraction fan. The worker rollers 7 rotate in a direction opposite to that of the barrel 1, and the teeth of the worker rollers 7 point in a direction counter to the direction of rotation of rollers 7. The worker rollers may by way of example have diameters of 100 mm so that, for example, at a rotational speed of 270 revolutions per minute the resultant peripheral speed will be 1.4 m/sec. The circumferential speed of the worker rollers may be varied in accordance with relevant conditions, and this variation is preferably in a range of from 1 to 6.5 m/sec.

The two worker rollers 7 are followed by a take-off and ejector roller 8 the direction of rotation of which is counter to the direction of rotation of the barrel 1. This take-off roller may, by way of example, have also a diameter of 100 mm so as to produce a peripheral speed of about 42 m/sec at a preferred rotational speed of 8000 revolutions per minute. The circumferntial speed of the take-off roller 8 may altogether be varied in a range of from 20 to 50 m/sec.

In the direction of rotation of the barrel 1 the angular spacing between the draw-in roller 3 located substantially on a horizontal line through the center of the barrel 1 and the take-off roller 8, in the illustrated embodiment, amounts to 200° to 235°.

To permit the continuous extraction of fine dust from above the saw tooth barrel 1, a suction aperture of a dust extraction duct 21 connected to a vacuum source is located substantially in the whole upper region of the saw tooth barrel. During operation of the apparatus a certain amount of fine dust is derived by detachment through centrifugal force from the saw tooth barrel at the peripheral speed of for example 23 m/sec. These fine dust particles adhering to the saw teeth mounting and not previously removed by the take-off roller are propelled into the empty space above the saw tooth barrel 1. The suction aperture of the dust extraction duct 21 occupies substantially the entire free space between the take-off roller 8 and the draw-in roller 3.

The fiber-draw-off roller 8 is surrounded over an arc of about 90° to 180°, preferably about 135°, by an arc-shaped baffle plate which has its rear end, with respect to the direction of rotation of the take-off roller 8, movably linked to a retaining plate 24 fixed to a machine frame 25. The baffle plate 22 is additionally fixed to an adjusting device having an adjusting spindle 26, through which it is possible to adjust the baffle plate relative to the take-off roller 8 in the direction of the arrows f1, f2 and f3. The front free edge 22' of the baffle plate 22 is spaced by a distance of between 0 and 10 mm, preferably 0.2 mm, from a generating line, or the overall periphery, of the saw tooth barrel 1 or rather the saw tooth mounting on this drum 1. The distance between the front free edge 22' of the baffle plate and the "approximate tangent" between the saw tooth barrel 1 and the take-off barrel 8 is preferably 30 to 50 mm, more specifically 35 mm. This "approximate tangent" is substantially determined by the zone in or at which the saw tooth mountings of the saw tooth barrel 1 and the draw-off roller 8 come closest without however touching.

Viewed in the direction of rotation of the draw-off roller 8, behind the rear edge of the baffle plate 22 is provided a trash removal duct 27, the aperture of which is substantially determined by the spacing g and which is for example about 25 mm wide.

Adjoining the trash removal duct 27 is a duct 28 leading to a not-shown fiber-material collection bin. This duct 28 is separated by a trash or separating knife 29 from the trash removal duct 27. The trash or separating knife 29 is made from a high-grade 0.5 to 1.5 mm thick sheet metal, which is clamped in a distortion resistant support structure 30. In the event of wear the piece of steel sheet can be simply removed and reground or replaced as required.

The trash knife has the function of separating trash and product fibers on the take-off roller 8 and is adjustable relative to this take-off roller both in respect of distance (arrow h) and angle.

The fiber material detached by the take-off roller 8 from the saw tooth barrel 1 together with any adherent trash is, as the result of the very high peripheral speed of the take-off roller, appropriately accelerated due to the effect produced by the baffle plate partially surrounding the take-off roller 8 so that at the outlet of the guiding channel formed by the baffle plate 22 there occurs a separation between trash and prduct fibers due to the centrifugal force acting upon the material. The trash separation in this context takes place solely under the influence of the centrifugal force so that no artificially-created partial vacuum is needed in the zone of the trash removal duct 27.

In the arrangement of FIG. 2 the take-off roller 8 is preceded by only a single worker roller 7 so that it is possible to enlarge the suction aperture of the duct 28, leading to the fiber collection bin, facing the take-off roller 8. This allows the drawing off of fiber material from the take-off roller 8 over a greater zone and also allows the trash knife 29 to be adjusted in an almost tangential direction with respect to the take-off roller 8.

FIG. 2 shows also the trough plate 2 forming part of the draw-in means.

In the embodiment in accordance with FIG. 2 a grill preceding the worker roller 7 may be replaced by a prior-art type cover mounting 31.

In the embodiment shown in FIG. 3 the last worker roller 7 is also replaced by a fixed cover mounting (Cardmaster® Trademark) 32 as a result of which a very much larger work-effective area of contact is achieved in the region of the unravelling section. A more favorable unravelling of the fibers and thereby a better separation of product fibers from trash is effected in this way.

The following saw tooth mountings in the form of saw-toothed members having the following parameters are fitted to the various rollers:

Saw tooth barrel: 0°, 12 threads per inch, pitch 6.5 mm

Draw-in roller: 0°, 12 threads per inch, pitch 6.5 mm

Worker roller: 10°, 16 threads per inch, pitch 4 mm

Take-off roller: 30°, 16 threads per inch, pitch 4 mm

The saw-toothed members to which the above table refers are elongate saw-toothed members arranged helically on the saw tooth barrel and on the draw-in, worker and take-off rollers, and in said table: (a) the expression "threads per inch" means the number of rows of saw teeth per inch measured parallel to the barrel or roller axis; (b) the expression "pitch" means the distance between adjacent saw teeth measured along a row of teeth; and (c) each of the angles specified is the angle between the shorter side of a saw tooth of a saw-toothed member and a radius of the respective part (barrel or roller) on which said saw-toothed member is mounted.

Figure 4:
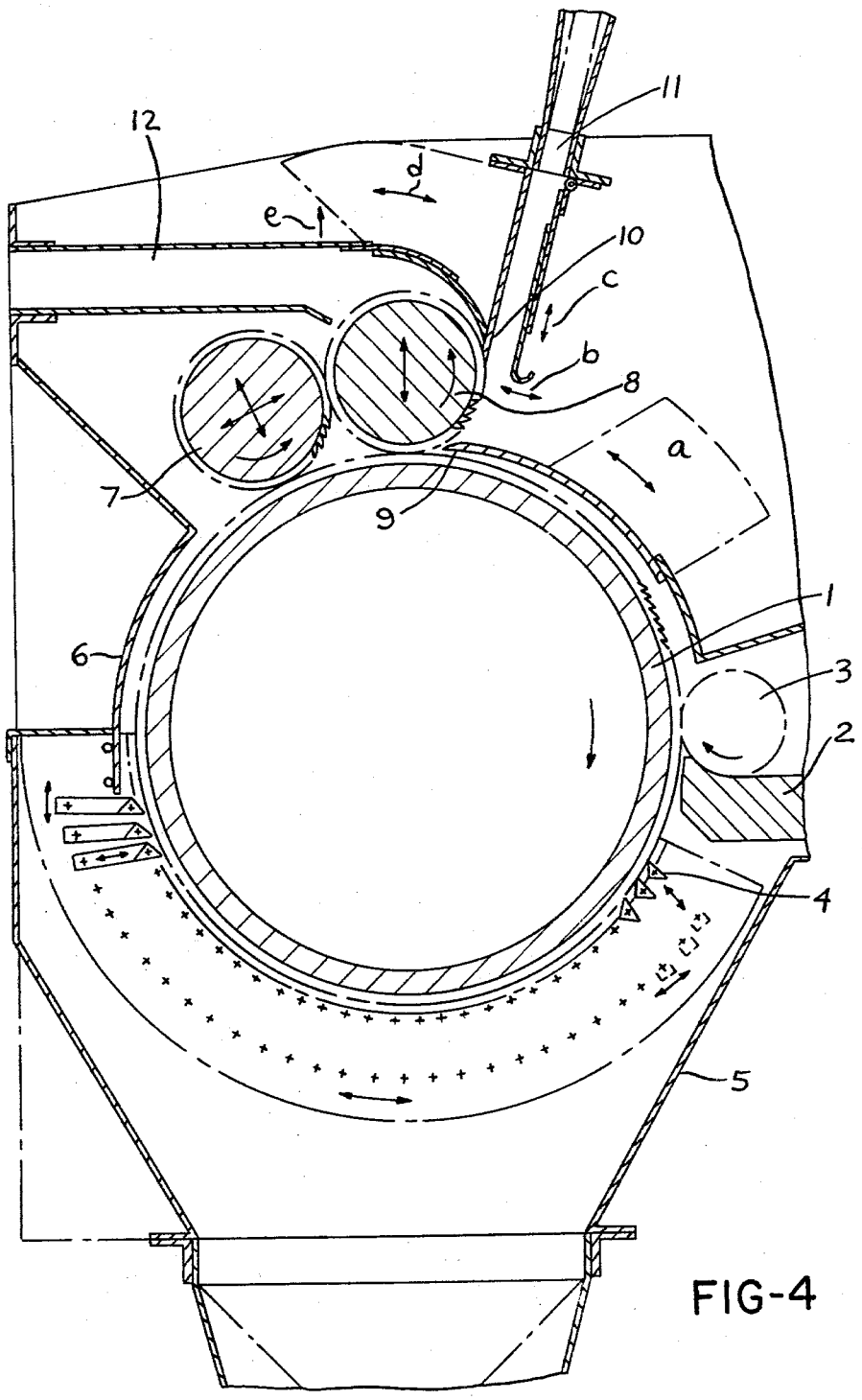
FIG. 4 is a diagrammatic view, partially in section, of another modified embodiment constructed in accordance with the invention.

The arrangement shown in FIG. 4 comprises a saw tooth barrel 1 to which the fiber material requiring to be opened is fed by means of a draw-in unit which comprises a trough plate 2 and a fluted roller, more specifically a fluted draw-in roller, 3. The fluted roller 3 and the saw tooth barrel 1 rotate in like directions and the teeth of the saw tooth barrel 1 point in the direction of rotation of the saw tooth barrel 1.

A bar grill made up of a plurality of grill bars 4 follows after the fiber material draw-in unit. The grill bars are preferably supported in a way which leaves them free to move. A collector funnel leading to a dust extraction fan is preferably located underneath the grill made up by these grill bars 4.

Viewed in the direction of rotation of the saw tooth barrel 1, the grill is followed by a part 6 of a casing wall followed by a worker roller 7 rotating counter to the direction of rotation of the saw tooth barrel 1. The teeth of this worker roller point against the direction of rotation. The relative position of the worker roller 7 to the barrel 1 is both radially and tangentially adjustable.

The worker roller 7 is followed by a take-off and ejection roller 8 rotating in a direction opposite to that of the barrel 1. This take-off and ejection roller 8 is radially adjustable in respect of the barrel 1. The take-off and ejection roller 8 is followed, in a peripheral direction along the barrel 1, by a separating knife 9 the cutting edge of which points toward the roll gap between the barrel 1 and the roller 8. This separating knife is adjustable in the directions of the double-headed arrow a peripherally of the barrel 1.

A further separating knife 10 is assigned, above this separating knife 9, to the take-off and ejection roller 8. This latter knife separates a duct 11 leading to a dust collection bin from a duct 12 leading to a fiber-material collector bin. Not-shown fans are preferably fitted in these two ducts 11 and 12. The separating knife 10 and the walls of the ducts 11 and 12 are adjustable specifically in the direction of the arrows, b, c, d, and e.

Figure 5:
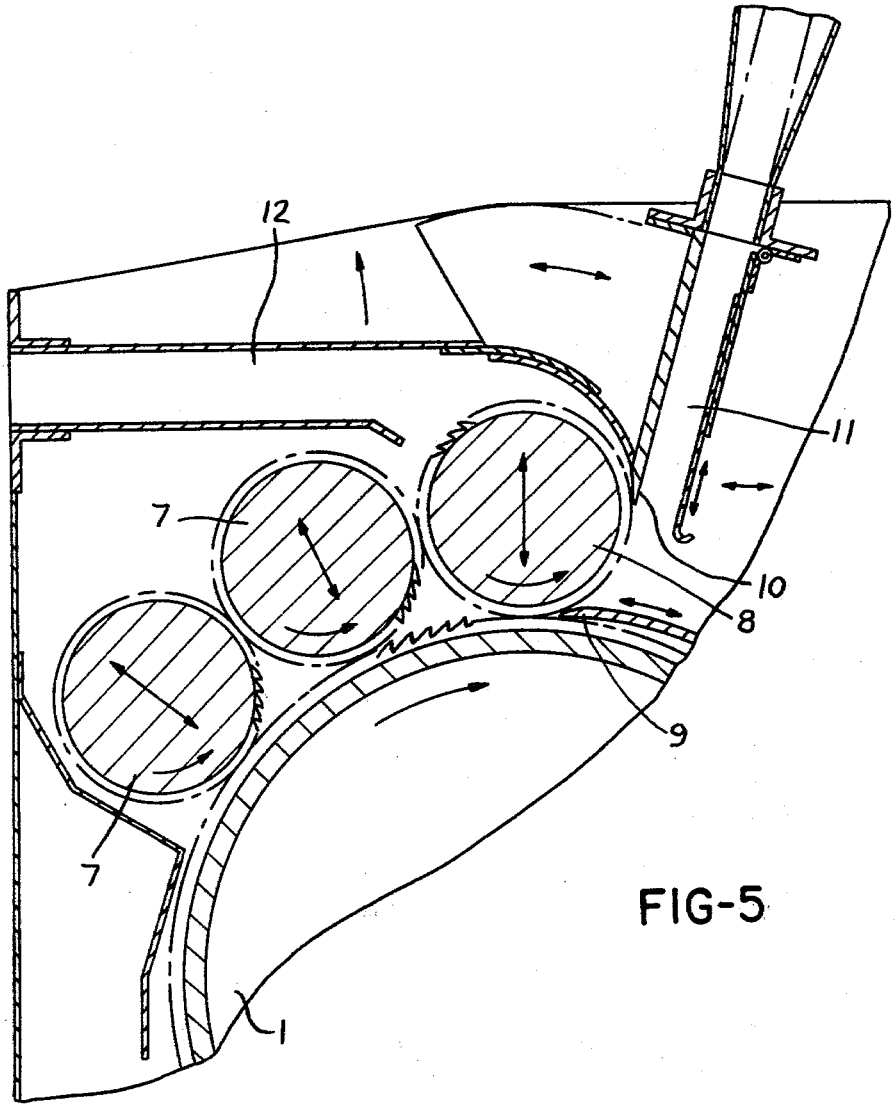
FIG. 5 is a view of a detail of a modification of the apparatus shown in FIG. 1.

The apparatus shown in FIG. 5 differs from the apparatus shown in FIG. 4 in that two worker rollers 7 are assigned to the take-off and ejection roller 8. Of these, the worker roller 7 directly preceding the take-off and ejection roller 8, may have a slightly higher circumferential speed than the worker roller 7 preceding it.

Figure 6:
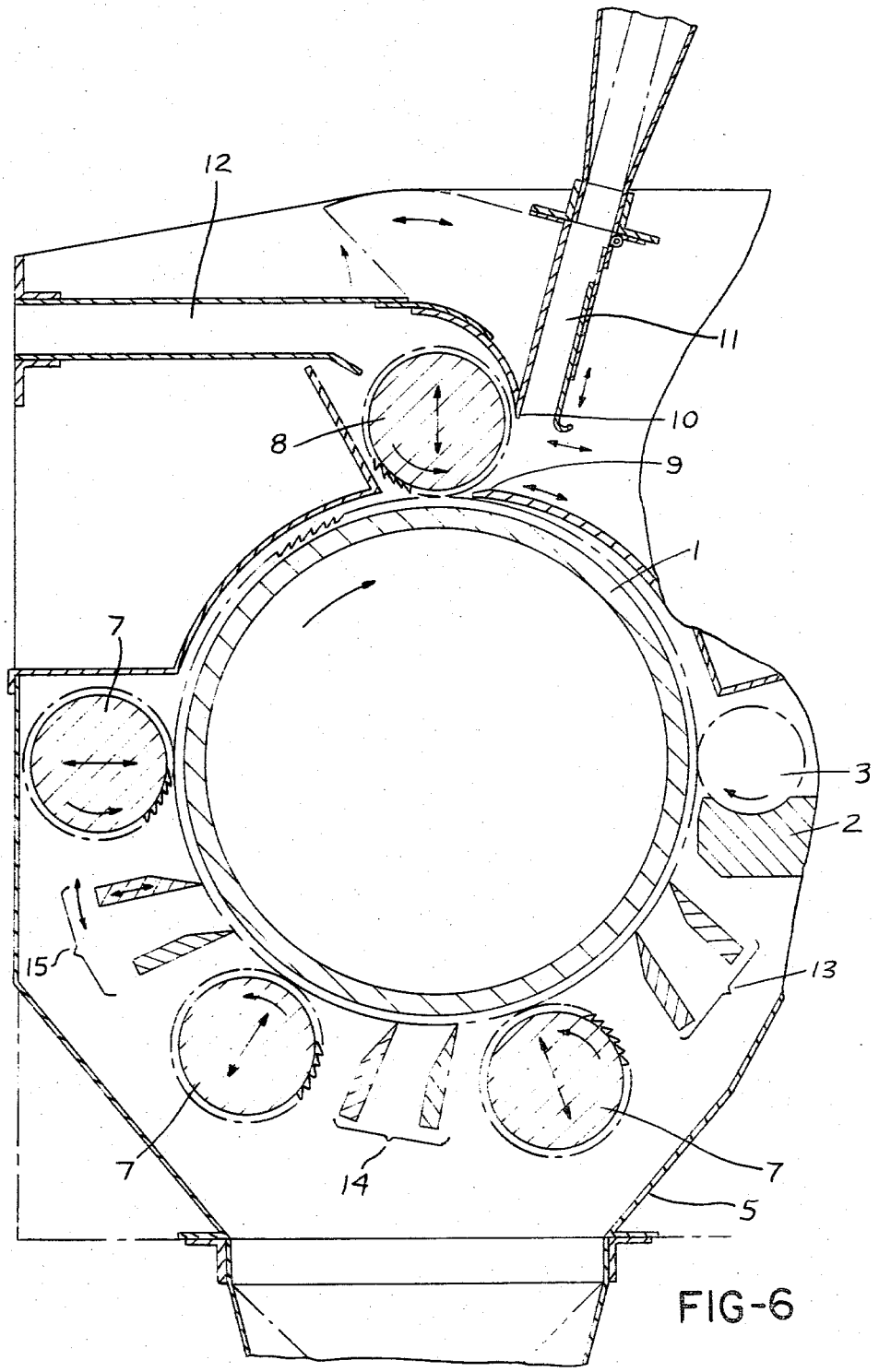
FIG. 6 is a diagrammatic view, partially in section, of a further modified embodiment of the invention.

In the apparatus shown in FIG. 6 the fiber material draw-in unit 2, 3 is followed by several groups of knives 13, 14, 15 which each alternate with worker rollers 7 of the kind described in connection with FIG. 4.

The take-off and ejection roller 8 with its associated separating knives 9 and 10 and the two ducts 10 and 11 correspond to those in the embodiment which are described in connection with FIG. 4.

The knives constituting the knife groups 13, 14 and 15 are adjustable and/or removable in respect of their clearance angles and radial spacings to the saw tooth barrel 1.

Figure 7:
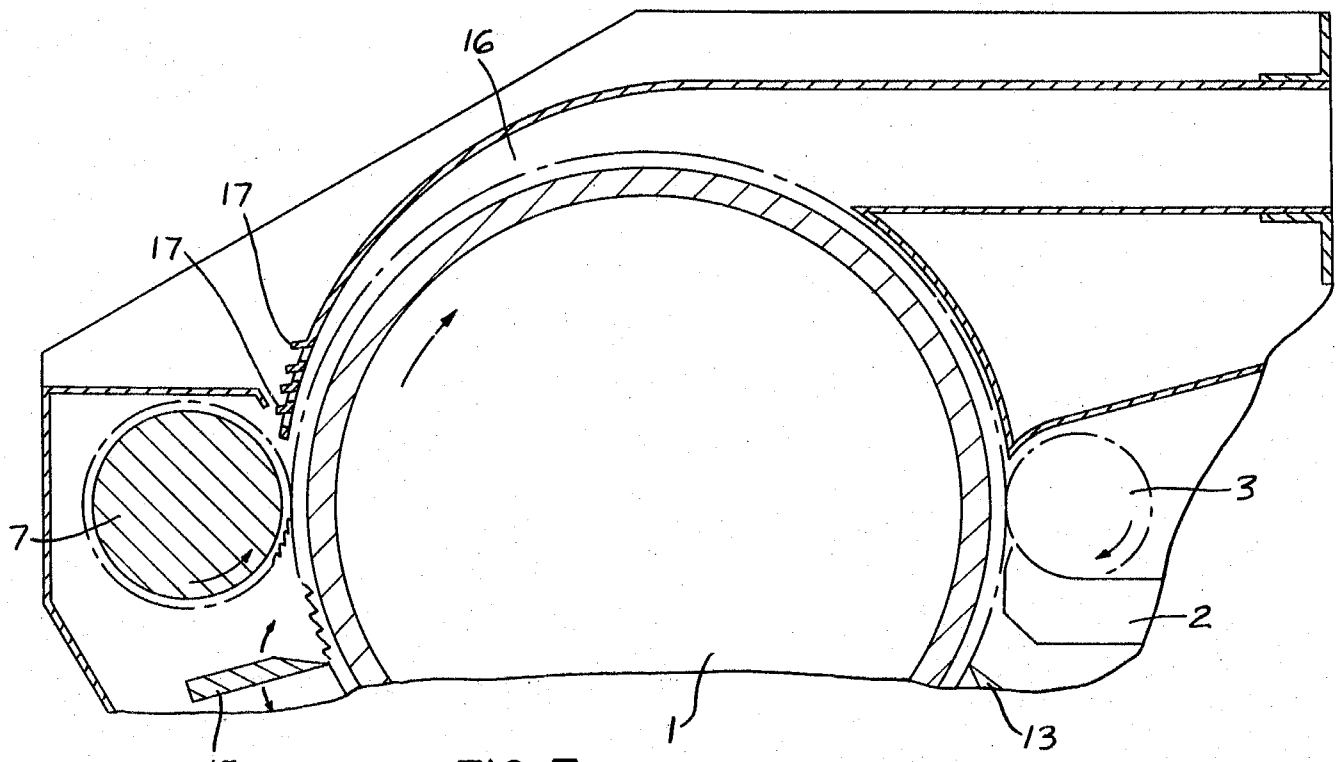
FIG. 7 is a view of a detail of a modification of the apparatus shown in FIG. 6.

The embodiment shown in FIG. 7 corresponds to the embodiment described in connection with FIG. 6 with regard to the fiber-draw-in unit 2, 3 and the arrangement of the groups of knives 13, 14 and 15 and the worker rollers 7. In the embodiment shown in FIG. 7, the last worker roller 7 is followed by a continuously widening fiber-material removal duct 16 partially surrounding the saw tooth barrel 1 and merging with the duct leading to the fiber-material collection bin. Adjoining the last working roller 7, several air inlet apertures 17 open into this fiber-material removal duct 16. In conjunction with the air inlet apertures 17, this fiber-material removal duct 16 substantially takes over the function of the fiber-material take-off means and is intended for a more gentle taking-off of better quality material.

The peripheral velocity of the saw tooth barrel 1 is substantially larger than the peripheral speed of the draw-in or fluted roller 3. The circumferential speed of the draw-in or fluted roller 3 is preferably 0.47 to 4.3 m/min, especially at about 0.8 m/min, while the peripheral speed of the saw tooth barrel 1 is 11 to 31 m/sec, especially at about 23 m/sec. The worker rollers 7 are preferably driven so as to have a peripheral speed of 1 to 6.5 m/sec, especially about 4 m/sec, while the circumferential speed of the take-off and ejection roller is 20 to 50 m/sec, especially 42 m/sec.

Figure 9:
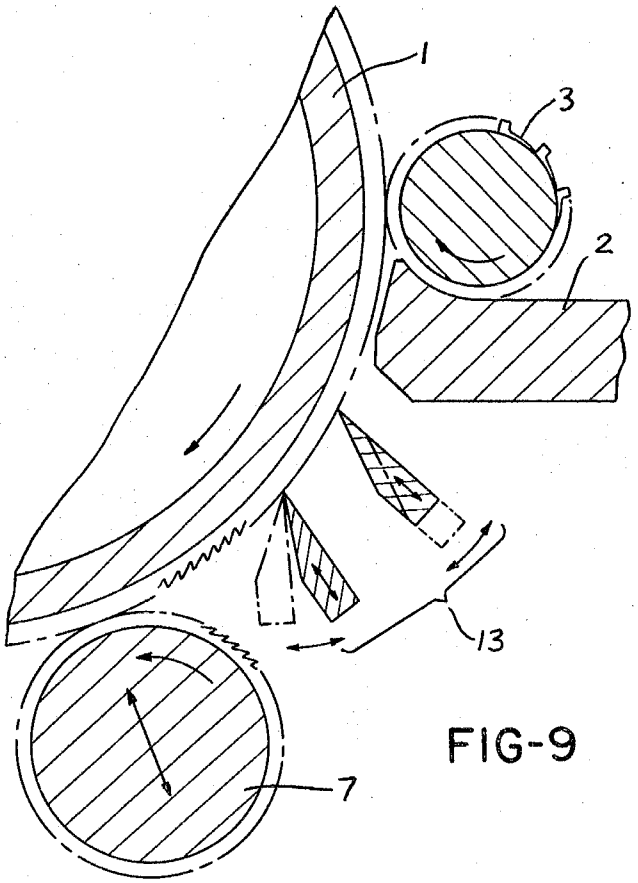
FIGS. 8 and 9 are detail views of a movable support for grill bars and grill blades (knives).
Figure 8:
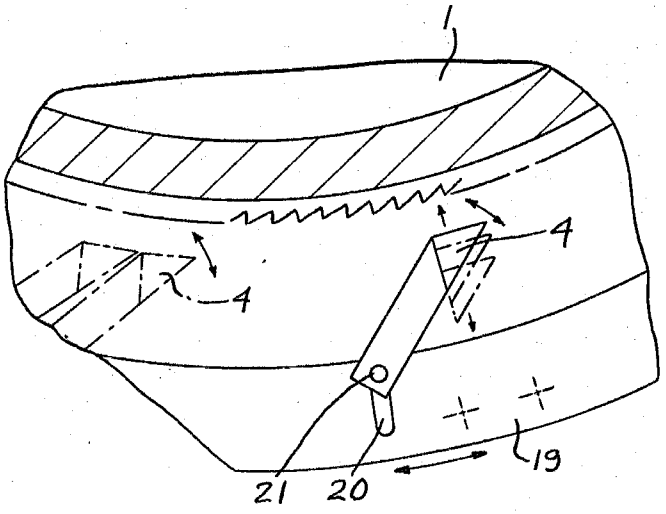

FIG. 8 indicates the manner in which the grill bars 4 can be adjusted, while the manner in which the knives making up the knife groups can be adjusted is shown diagrammatically in FIG. 9. According to FIG. 8, the grill bars are fixed by means of retaining bars 18 on a bar 19 movable in peripheral direction along the barrel 1. This bar 19 is provided with radial slots 20 along which the retaining bars may be displaced. The retaining bars 18 are fixed by means of screws 21 to the bar 19 which provides at the same time a possibility of adjustment of the clearance angle of the grill bars 4 in relation to the saw tooth barrel 1.

It is, of course, to be understood that the present invention is in no way limited to the specific showing in the drawings, but also encompasses any modifications within the scope of the appended claims.

What I claim is:

1. An apparatus for the opening and cleaning of cotton waste, especially strips, card fly, and scutcher material, which includes: a rotatable saw tooth barrel, a fiber material draw-in roller for feeding the fiber material to be cleaned to said saw tooth barrel, said saw tooth barrel having a circumferential surface circumferential sections of which with said saw tooth barrel in condition of rotation successively forming a loosening-up section for loosening-up the fiber material received by said saw tooth barrel, said loosening-up section when viewing said saw tooth barrel in its direction of rotation being followed by a rotatable fiber material take-off roller rotatable in a direction counter to the direction of rotation of said saw tooth barrel, and conduit means having an inlet adjacent said circumferential surface of said fiber material take-off roller for receiving fiber material from the latter and having an outlet for connection to a fiber material collection container.

2. An apparatus according to claim 1, which includes an arc-shaped guiding member extending over a peripheral section of said fiber material take-off roller and having an exposed front edge arranged in spaced relationship to and facing a peripheral surface portion of said saw tooth barrel.

3. An apparatus according to claim 2, in which the distance between said exposed front edge of said guiding member and the approximate contact area of the peripheral saw tooth barrel surface with the peripheral surface of said fiber material take-off roller is within the range of from 30 to 50 mm, while the gap between said exposed front edge and the circumferential line of said saw tooth barrel is within the range of from 0 to 10 mm.

4. An apparatus according to claim 3, in which said first mentioned distance is about 35 mm.

5. An apparatus according to claim 3, in which said gap has a width of about 0.2 mm.

6. An apparatus according to claim 2, which includes adjusting means operatively connected to said guiding member for adjusting said guiding member relative to said fiber material take-off roller.

7. An apparatus according to claim 2, which includes a dust withdrawal duct having a suction opening and being located behind said guiding member when viewing said saw tooth barrel in its direction of rotation, said suction opening being directed toward said saw tooth barrel and extending substantially from said guiding member to said fiber material draw-in roller.

8. An apparatus according to claim 2, in which said guiding member extends about said fiber material take-off roller over an angular range of from 80° to 180°.

9. An apparatus according to claim 2, in which said guiding member extends about said fiber material take-off roller over an angle of about 135°.

10. An apparatus according to claim 2, in which said guiding member has one end portion adjacent the periphery of said saw tooth barrel and has its other end portion remote from the periphery of said saw tooth barrel and pivotally mounted.

11. An apparatus according to claim 10, in which said rear end portion of said guiding member is followed by a trash removal duct when viewing said fiber material take-off roller in its direction of rotation, and in which adjacent said trash removal duct there is arranged a conduit separated from said trash removal duct by separating blade means, said last mentioned conduit having an inlet adjacent the periphery of said fiber material and having an outlet connectable to a fiber material collecting chamber.

12. An apparatus according to claim 11, in which said separating blade means is adjustable relative to said fiber material take-off roller both in respect of distance and angle.

13. An apparatus according to claim 11, which includes supporting means having said separating blade means clamped therein.

14. An apparatus according to claim 13, in which said supporting means includes high grade steel plates having a thickness of from 0.5 to 1.5 mm.

15. An apparatus according to claim 11, which includes a first fan located in said trash removal duct, and a second fan located in said conduit having an outlet connectable to a fiber material collecting chamber.

16. An apparatus according to claim 1, in which said fiber material take-off roller is preceded by a fixed cover mounting.

17. An apparatus according to claim 1, in which the ratio of the circumferential speed between said saw tooth barrel and said material take-off roller is between 11 and 31 m/sec: between 20 to 50 m/sec.

18. An apparatus according to claim 1, in which the ratio of the circumferential speed between said saw tooth barrel and said material take-off roller is 23 m/sec: 42 m/sec.

19. An apparatus for the opening and cleaning of cotton waste, especially strips, card fly and scutcher material, which includes: a rotatable saw tooth barrel, a fiber material draw-in roller for feeding the fiber material to be cleaned to said saw tooth barrel, said saw tooth barrel having a circumferential surface, at least one worker roller associated with said circumferential surface and having a circumferential speed less than that of said saw tooth barrel, feeding the fiber said fiber material draw-in roller having a circumferential speed less than that of said saw tooth barrel, a grill comprising a plurality of grill members located past said draw-in roller and ahead of said at least one worker roller when viewing said saw tooth barrel in its direction of rotation.

20. An apparatus according to claim 19, in which said draw-in roller has a peripheral speed of from 0.47 to 4.3 m/min while said saw tooth barrel is rotatable at a peripheral speed of from 11 to 31 m/sec and said at least one worker roller is rotatable at a peripheral speed of from 1 to 6.5 m/sec.

21. An apparatus according to claim 20, in which said draw-in roller has a peripheral speed of about 0.8 m/min.

22. An apparatus according to claim 19, in which said at least one worker roller is followed by a fiber material take-off roller, and which includes at least one separating member associated with said fiber material take-off roller, and a duct having an inlet adjacent said fiber material take-off roller and an outlet for connection with a fiber material collecting container.

23. An apparatus according to claim 22, in which said take-off roller is preceded by said at least one worker roller, and in which said grill is located between said fiber material draw-in roller and said at least one worker roller.

24. An apparatus according to claim 23, in which said grill is succeeded by at least two worker rollers, and in which the transmission ratio between said saw tooth barrel and said last mentioned worker rollers is such that the speed of rotation of said worker rollers respectively slightly increases in the direction of rotation of said saw tooth barrel.

25. An apparatus according to claim 24, in which when viewing in the direction of rotation of said saw tooth barrel the draw-in roller is succeeded alternately by at least one grill knife and at least one worker roller having the teeth thereof point in the direction counter to the direction of rotation thereof, the respective last worker roller being succeeded by a take-off roller.

26. An apparatus according to claim 19, which includes: a fiber material take-off and ejection roller arranged behind said at least one worker roller, at least one separating member adjacent said take-off and ejection roller, and duct means adjacent said separating member and respectively operatively connected to said take-off and ejection roller and respectively connectable to a fiber material collecting container and a dust collecting container.

27. An apparatus according to claim 19, in which said grill members are adjustably arranged.

* * * * *